US007439995B2

(12) United States Patent
Ali et al.

(10) Patent No.: US 7,439,995 B2
(45) Date of Patent: Oct. 21, 2008

(54) METHOD AND APPARATUS FOR LASER INDUCED THERMAL TRANSFER PRINTING

(75) Inventors: Mohammad Zaki Ali, Mendota Heights, MN (US); Jianbing Huang, Trumbull, CT (US)

(73) Assignee: Kodak Polychrome Graphics, GmbH, Osterodel Harz (DE)

( * ) Notice: Subject to any disclaimer, the term of this patent is extended or adjusted under 35 U.S.C. 154(b) by 407 days.

(21) Appl. No.: 11/259,754

(22) Filed: Oct. 26, 2005

(65) Prior Publication Data

US 2006/0090661 A1 May 4, 2006

Related U.S. Application Data

(63) Continuation-in-part of application No. 11/118,761, filed on Apr. 29, 2005, now abandoned, which is a continuation of application No. 10/071,528, filed on Feb. 8, 2002, now Pat. No. 6,894,713.

(51) Int. Cl.
*B41J 2/325* (2006.01)

(52) U.S. Cl. ..... 347/217

(58) Field of Classification Search ..... 347/217, 347/222, 224, 262, 176, 173, 172, 171; 400/618, 400/613.3, 124.11, 120.02, 120.04; 101/211, 101/75, 48; 427/348; 250/548; 528/44; 430/339, 204

See application file for complete search history.

(56) References Cited

U.S. PATENT DOCUMENTS 3,511,656 A * 5/1970 Lincoln et al. ..... 430/204
3,964,389 A 6/1976 Peterson
4,245,003 A 1/1981 Oransky et al.
4,250,511 A 2/1981 Stein et al.
4,399,749 A 8/1983 Arai
4,804,975 A 2/1989 Yip
4,819,018 A 4/1989 Mayroud et al.
4,958,564 A 9/1990 Fuhrmann et al.
5,053,791 A 10/1991 Baek et al.
5,072,671 A 12/1991 Schneider et al.
5,172,136 A 12/1992 Stephenson, III
5,238,778 A 8/1993 Hirai et al.
5,257,038 A 10/1993 Ferschl et al.
5,368,893 A 11/1994 Sommer et al.
5,379,693 A 1/1995 Hoffmann et al.
5,401,606 A 3/1995 Reardon et al.
5,424,759 A 6/1995 Burberry
5,440,987 A 8/1995 Williams et al.
5,446,447 A 8/1995 Carney et al.
5,481,975 A 1/1996 Schulz (Continued)

*Primary Examiner*—K. Feggins
(74) *Attorney, Agent, or Firm*—J. Lanny Tucker

(57) ABSTRACT

An apparatus and method for providing substantially intimate rolling contact between a portion of a donor sheet and a portion of an acceptor element in a laser-induced thermal transfer printer comprises a rotatably mounted cylindrical drum, an acceptor element affixed to and supported by the cylindrical drum, a rotatably mounted dispensing roller for dispensing a donor sheet, and a rotatably mounted receiving roller for receiving the donor sheet, so that the donor sheet is extended between the dispensing roller and the receiving roller. A plurality of rotatably mounted contact rollers configured to bring a portion of the donor sheet extended between the dispensing roller and the receiving roller into contact with a portion of the acceptor element is also included.

10 Claims, 13 Drawing Sheets

U.S. PATENT DOCUMENTS 5,607,810 A 3/1997 Verburgh et al.
5,675,369 A 10/1997 Gaskill
5,734,409 A 3/1998 Rombult et al.
5,757,313 A 5/1998 Meneghini et al.
5,764,268 A 6/1998 Bills et al.
5,818,493 A 10/1998 McLain et al.
5,819,661 A 10/1998 Lewis et al.
6,038,975 A * 3/2000 Hoffmann et al. ..... 101/375
6,052,144 A 4/2000 Reyner
6,058,842 A 5/2000 Mayr
6,080,993 A 6/2000 Zwijsen
6,204,874 B1 3/2001 Michelson
6,222,567 B1 4/2001 Schuster et al.
6,291,143 B1 9/2001 Patel et al.
6,304,281 B1 * 10/2001 Weichmann et al. ..... 347/217
6,894,713 B2 5/2005 Moulin et al.
6,899,814 B2 5/2005 Schneider et al.
6,928,926 B2 8/2005 Koifman et al.
2004/0097684 A1 * 5/2004 Bruchmann et al. ..... 528/44

* cited by examiner

METHOD AND APPARATUS FOR LASER INDUCED THERMAL TRANSFER PRINTING

CROSS-REFERENCE TO RELATED APPLICATIONS

This application is a continuation-in-part of application Ser. No. 11/118,761, filed Apr. 29, 2005, which is a continuation of application Ser. No. 10/071,528, filed Feb. 8, 2002, now U.S. Pat. No. 6,894,713. Each of these applications is incorporated by reference in its entirety.

BACKGROUND OF THE INVENTION

1. Field of the Invention

The present invention relates to laser-ablation transfer printing processes and laser-induced melt-transfer printing processes. More specifically, the present invention relates to techniques for providing contact between a donor sheet and an acceptor element in laser-ablation transfer processes and laser-induced melt-transfer processes, and for conducting laser-scanning in connection therewith.

2. Background Information

Laser-ablation transfer printing and laser-induced melt-transfer printing (collectively referred to herein as laser-induced thermal transfer printing) involve the transfer of a material from a donor sheet to an acceptor element to form a representation of an image on the acceptor element. During this transfer, it is necessary for the donor sheet and acceptor element to be held in contact with one another. The transfer of material is thermally induced by the application of a scanning laser beam at selected points across the donor sheet-acceptor element combination.

Laser-induced thermal transfer printing is well known to be useful for producing halftone color proofs, films, printing plates, printing cylinders, and other printing forms. Specifically, this type of transfer printing is known to be particularly useful for applying an ink-accepting coating onto a seamless sleeve having a hydrophilic surface, and also for applying an ink-repelling material onto an ink-accepting surface. Processes for using laser-induced thermal transfer printing to make printing plates, printing cylinders, and other printing forms are well known and are described for example in U.S. Pat. Nos. 3,964,389 and 5,819,661, which specifically address laser-ablation transfer printing and laser-induced melt-transfer printing, respectively.

The composition of the donor sheets and acceptor elements used in connection with laser-induced thermal transfer printing is likewise well known in the art. For example, U.S. Pat. No. 5,757,313 discusses donor elements containing polymerization initiators, and U.S. Pat. No. 5,238,778 discloses donor elements containing photo-curable compositions. U.S. Pat. No. 5,607,810 discloses a peel-apart assembly which can include donor elements having transferable dyes and acceptor elements having non-proteinic hydrophilic surfaces. U.S. Pat. No. 5,401,606 describes a laser-induced melt transfer process in which a melt viscosity modifier is utilized to better facilitate the melt transfer process between the donor and acceptor.

In laser-induced thermal transfer printing processes, it is known that the donor sheet and acceptor element must be held in contact with one another with relatively uniform contact pressure across the donor-acceptor combination, to insure uniform transfer characteristics for a specified level of laser energy. In connection with such printing processes, donor sheets and acceptor elements traditionally have been pre-assembled into a subassembly. The donor-acceptor subassembly has been attached to either an internal drum or an external drum for laser imaging. Once the laser imaging has been completed, the donor sheet and the acceptor element have been separated from one another. In printing plate and cylinder-making applications, the acceptor typically has been used as the plate or cylinder.

For certain laser-induced thermal transfer printing applications, it has been considered desirable to assemble donors and acceptors directly on the imaging device. Where an external drum arrangement has been used in such techniques, the acceptor element typically has been first affixed to the outer circumference of the drum, and the donor sheet has then been secured over and substantially coextensively with the acceptor element. Certain laser-induced thermal transfer printers of the prior art, such as those disclosed in U.S. Pat. No. 5,446,477, have used vacuum drum arrangements to achieve the requisite sufficiently uniform contact between the donor sheet and acceptor element. Such vacuum drum arrangements have added significant cost, size, and complexity to the printers in which they are used, however.

Certain other laser-induced thermal transfer printers of the prior art, such as those disclosed in U.S. Pat. No. 5,764,268, have provided contact between the donor sheet and the acceptor element without the need for a vacuum drum arrangement. Such laser-induced thermal transfer printers have utilized dedicated tensioning mechanisms and clamping devices to apply tension to the donor sheet, and to draw the donor sheet into contact with the acceptor element.

In addition to laser-induced thermal transfer printing techniques, other types of thermal transfer printing utilizing the assembly of donors and acceptors directly on the imaging device are also well known in the art. For example, U.S. Pat. No. 5,072,671, the contents of which is incorporated herein by reference, discloses an apparatus and method for transferring an imaged donor layer generated by a thermal recording head from an intermediate support to an acceptor via a reproducing means. Specifically, this transfer is accomplished by transferring meltable particles from the donor layer onto a deformable acceptor surface. U.S. Pat. No. 4,958,564 describes a method of using a rigid thermal head to transfer a donor substance from a donor support to an intermediate surface, and of then transferring the donor substance from the intermediate surface to the final acceptor. This patent also discloses the technique of transferring to a rigid printing form the donor substance which remains on the donor support after the above-described transfer of the donor substance from the donor support to the intermediate surface.

U.S. Pat. No. 4,804,975 describes a thermal dye transfer apparatus which absorbs heat from a laser light. Donor sheets and acceptor elements are hard pressed into close contact in the projection area by a pressure plate.

Therefore, in view of the above-described examples and limitations in the existing art, a need has arisen for further laser-induced thermal transfer printing techniques in which donors and acceptors are assembled directly on the imaging device. A need has also arisen for such techniques which do not require vacuum drum arrangements or dedicated tensioning mechanisms and clamping devices to maintain the requisite contact pressure across the donor sheet-acceptor element combination. A need has also arisen for such techniques which eliminate the need for manual separation of donor sheets and acceptor elements. A need has also arisen for such techniques which eliminate the need for disposal of donor supports once the printing process has been completed, and in which donor supports instead can be recoated with donor material, thereby reducing waste and cost. A need has also arisen for such techniques in which donor sheets can be conveniently supplied on rolls.

SUMMARY OF THE INVENTION

The details of the preferred embodiments of the present invention are set forth in the accompanying drawings and the description below. Once the details of the invention are known, numerous additional innovations and changes will become obvious to one skilled in the art.

In accordance with the present invention, an apparatus and method are provided for achieving substantially intimate rolling contact between a portion of a donor sheet and a portion of an acceptor element in a laser-induced thermal transfer printer which comprises a laser imaging head. The system includes a rotatably mounted cylindrical drum, an acceptor element which may be a sleeve-type acceptor or an acceptor element affixed to and supported by the cylindrical drum, a rotatably mounted dispensing roller for dispensing a donor sheet, and a rotatably mounted receiving roller for receiving the donor sheet, so that the donor sheet is extended between the dispensing roller and the receiving roller. The system also includes a plurality of rotatably mounted contact rollers configured to bring a portion of the donor sheet extended between the dispensing roller and the receiving roller into substantially coextensive contact along the width of a portion of the acceptor element. The laser imaging head does not contact either the donor sheet or the acceptor element.

The term "sleeve-type acceptor" as used herein is intended to indicate a substantially cylindrical hollow tube having an outer surface appropriate for a specific application. If the application is an image-carrying printing form for use on a lithographic printing machine, the outer surface of a sleeve acceptor should have an ink-affinity opposite to the ink-affinity of the transferred material from a donor ribbon. Examples of such sleeve-type acceptors can be found in U.S. Pat. Nos. 5,379,693 and 5,440,987, each of which is herein incorporated by reference. In the apparatus of the present invention, a sleeve-type acceptor is preferably supported by a cylindrical core having a radial expansion means or by two end caps mounted on both sides of the sleeve acceptor. Such mounting mechanisms are known in the art, as described, for example, in U.S. Pat. Nos. 6,038,975 and 5,481,975. In one embodiment, the sleeve-type acceptor is a re-imageable sleeve.

In accordance with an exemplary embodiment of the present invention, the acceptor element is affixed to the external surface of the cylindrical drum. In another embodiment, the acceptor element is integrally formed with the cylindrical drum. Suitable acceptor elements include lithographic, flexographic, gravure plate or cylinder precursors.

In accordance with another exemplary embodiment of the present invention, the contact rollers comprise a first and second contact roller in contact with the cylindrical drum, and configured so that the portion of the donor sheet brought into substantially coextensive contact, which may be either substantially static contact or substantially intimate rolling contact, with the acceptor element is the donor sheet portion located between the first and second contact rollers. Preferably, the first and second contact rollers are spring loaded contact rollers.

In accordance with another exemplary embodiment of the present invention, the first contact roller is located proximate to the dispensing roller and the second contact roller is located proximate to the receiving roller.

In accordance with another exemplary embodiment of the present invention, the cylindrical drum, dispensing roller, receiving roller and contact rollers rotate in a synchronous manner.

In accordance with another exemplary embodiment of the present invention, the laser-induced thermal transfer printer comprises a laser imaging head for providing scanning laser energy to transfer material from the donor sheet to the acceptor element to form a representation of an image on the acceptor element, and the portion of the donor sheet brought into substantially coextensive contact with the acceptor element is the donor sheet portion located generally proximate to the laser imaging head.

In another embodiment of the present invention, the apparatus includes a radiation source for applying radiation to the acceptor element after donor material has been transferred from the donor sheet onto the acceptor element. In a further embodiment, the apparatus may include a developer system for applying one or more developer materials onto the acceptor element after transfer of the donor material. The radiation source may be configured to apply ultraviolet, thermal or infrared radiation, and may cure the donor material applied to the acceptor element, and/or render portions of the acceptor element more or less soluble in a developer.

The developer system may be used to dissolve portions of the applied donor material or other materials disposed on the surface of the acceptor element to form a pattern on the acceptor element. Suitable developer systems may apply developer via spray, brush, immersion, and/or other suitable means for applying developer.

Another embodiment of the present invention provides a method for preparing a printing plate or cylinder using embodiments of the apparatus reported herein. A donor sheet having donor material is dispensed from the dispensing roller to the receiving roller so that the donor sheet moves uni-directionally perpendicular to the longitudinal axis of the drum. A plurality of rotatably mounted contact rollers bring a portion of the donor sheet extended between the dispensing roller and the receiving roller into substantially coextensive contact along the width of the acceptor element. A laser imaging head then causes a pattern of donor material to transfer from the donor sheet to the acceptor element to form a patterned acceptor element. The laser imaging head does not contact the donor sheet or the acceptor element. As used herein, the phrase "uni-directionally perpendicular to the longitudinal axis of the drum" refers to the movement of the donor sheet with respect to the longitudinal axis of the drum.

The method may optionally include exposing the rotatably mounted patterned acceptor element to radiation and, additionally, applying developer onto the rotatably mounted patterned acceptor element. The method can be used to prepare lithographic, flexographic, and/or gravure plates or cylinders as well as precursors of the foregoing.

In accordance with another exemplary embodiment of the present invention, contact rollers are not utilized. This exemplary embodiment includes a rotatably mounted cylindrical drum, an acceptor element which is an acceptor element affixed to and supported by the cylindrical drum, a rotatably mounted dispensing roller for dispensing a donor sheet, and a rotatably mounted receiving roller for receiving the donor sheet. The donor sheet is located between the dispensing roller and the receiving roller, and the dispensing roller and receiving roller are configured to bring a portion of the donor sheet located therebetween into substantially coextensive contact, which may be either substantially static contact or substantially intimate rolling contact, with a portion of the acceptor element.

The surfaces of the donor sheet and of the acceptor element are usually uneven, so that the donor and acceptor elements define both contact points and non-contact areas between the surfaces. This is particularly so when the acceptor element is an acceptor element. In the non-contact areas, the two surfaces are separated by small gaps. Unlike the case of thermal resistor head imaging, where material transfer occurs only in the contact points, in the present invention material transfer may take place even across a small gap. This occurs because the material being transferred from the donor sheet possesses some momentum due to the rapid thermal expansion and production of gaseous species. Therefore, material and image transfer in the present invention occur across both contact points and non-contact areas defined by the donor sheet and acceptor element.

BRIEF DESCRIPTION OF THE DRAWINGS

Further objects, features and advantages of the invention will become apparent from the following detailed description taken in conjunction with the accompanying figures showing illustrative embodiments of the invention, in which.

DETAILED DESCRIPTION OF THE INVENTION

Preferably, the apparatus comprises a projection area, and contact between the portion of the donor sheet and the portion of the acceptor element covers a substantial arcuate section comprising the projection area. The term "projection area" as used herein is intended to indicate the area on which the laser beam impinges. The contact between the portion of the donor sheet and of the acceptor element is achieved by simultaneously driving the two portions at the same speed along an arcuate section of the rotatably mounted cylindrical drum upstream of the projection area, whereby the portion of the acceptor element and the portion of the donor sheet move in unison. Preferably, the apparatus does not require pressure plates to achieve contact between the donor sheet and the acceptor element. This arrangement insures that there is no relative displacement between said portions in the arcuate section upstream of the imaging area. At a given tension value in the donor ribbon, the pressure between the donor sheet and receiving roller increases with decreasing radius of curvature.

Figure 1:
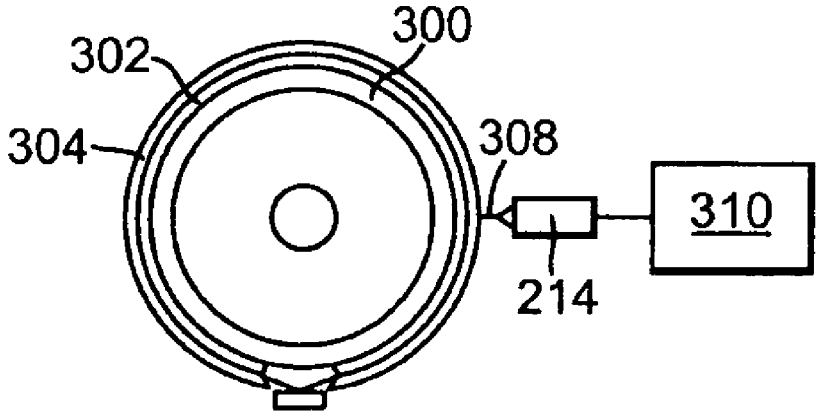
Fig. 1 (PRIOR ART)
FIGS. 1-3 depict exemplary prior art laser-induced thermal transfer printer devices.

FIG. 1 depicts a schematic representation of prior art components in the field of laser induced thermal transfer printing. In this figure, block 310 represents the electronics, programs, memories, and modulators necessary for the production of laser beams in accordance with image signals as known in the laser printer art. Block 310 controls laser head 214 that projects image-representing rays 308 to the surface of drum 300. A receptor sheet 302 is attached to the drum. A donor sheet 304 is pressed against the receiver sheet either by a vacuum, as described in U.S. Pat. Nos. 5,257,038 and 6,204,874 (both of which are incorporated by reference herein) or by a mechanism attached to the ends of the donor sheet, as described in U.S. Pat. No. 5,764,268 (herein incorporated by reference) to establish an appropriate pressure to the whole page of the donor-receiver sandwich. In each of U.S. Pat. Nos. 5,257,038, 6,204,874, and 5,764,268, as well as U.S. Pat. No. 5,734,409, intimate contact between donor and acceptor material is obtained by various complex means. Although primarily dedicated to the production of color proofs, the arrangements described in these patents are equally applicable to the production of printing plates as mentioned in U.S. Pat. No. 6,204,874.

Figure 2:
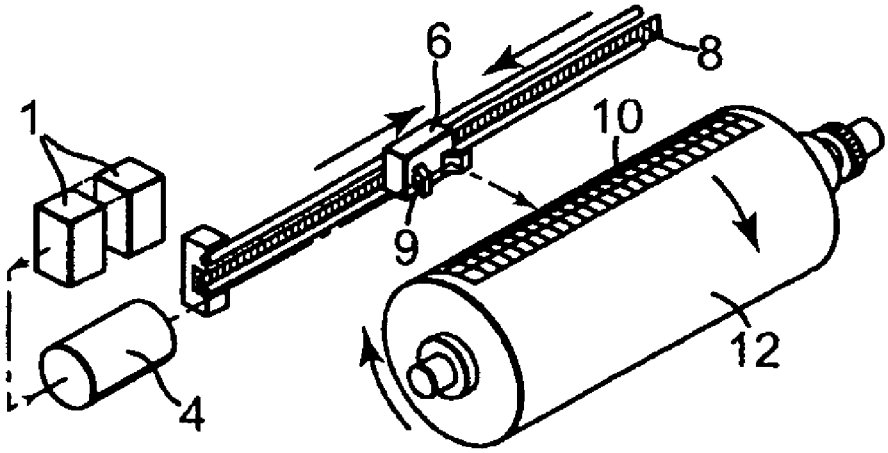
Fig. 2 (PRIOR ART)

Exemplary prior art embodiments also include laser-induced thermal transfer printing devices in which the entire imaging head resides on a carriage, such as is shown schematically in FIG. 2, in which controls 1 and a laser and optics element 4 are positioned operatively with a continuously moving carriage 6 moving on a track 8, such that an imaging head 9 is used to provide an image 10 on the acceptor element 12 located on roller 14.

Figure 3:
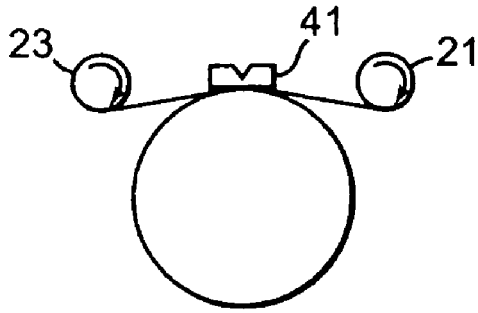
Fig. 3 (PRIOR ART)

FIG. 3 is a schematic diagram of the laser-induced thermal transfer printing device described in U.S. Pat. No. 4,804,975 (herein incorporated by reference). Unlike the embodiment of the present invention discussed in FIG. 4 below, in FIG. 3 there is no wrapping of the donor ribbon around an arcuate section of the drum. Instead, as described in U.S. Pat. No. 4,804,975, donor and acceptor are hard pressed into close contact in the projection area by pressure plate 41 located between supply roller 21 and take-up roller 23. In contrast, no pressure plates are employed in the present invention.

Figure 4:
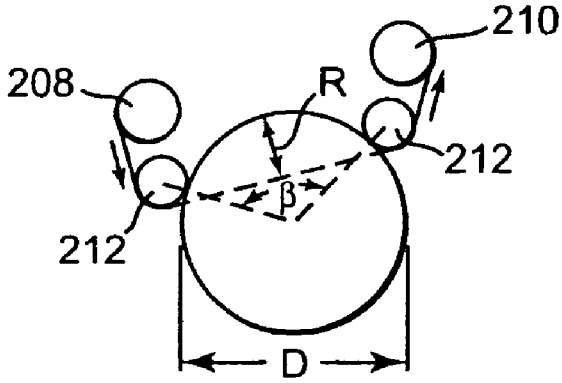
FIGS. 4-5 illustrate exemplary embodiments of the laser-induced thermal transfer printing device of the present invention, in which contact rollers are utilized to bring a donor sheet into contact with an acceptor element, where the acceptor element is an acceptor sheet.

FIG. 4 illustrates a schematic diagram of an exemplary embodiment of the laser-induced thermal transfer printing device of the present invention. The extent of the wrapping of the sheet around the drum in FIG. 4 is defined by the angle β subtended at the center of the drum by the radii joining the center of the drum and the centers of contact rollers 212. At a given tension value in the donor ribbon, the pressure between the donor and the receiver increases with decreasing radius of curvature. In the embodiments where a receiver sheet is affixed to the drum, a minimum drum size is dictated by the desired receiver sheet size. The contact pressure is controlled by the tension applied to the donor ribbon. The linear speed of the surface of the receiving element attached to the drum is kept identical to the linear speed of the donor sheet, regardless of the amount of material wound around the donor spools. Dispensing roller 208 is preferably controlled by a torque motor in order to maintain taut the section of the donor sheet between the roller 208 and the contact roller 212 proximate to the receiving roller 210. Receiving roller 210 is preferably frictionally biased to take up any slack that may be present.

Figure 5:
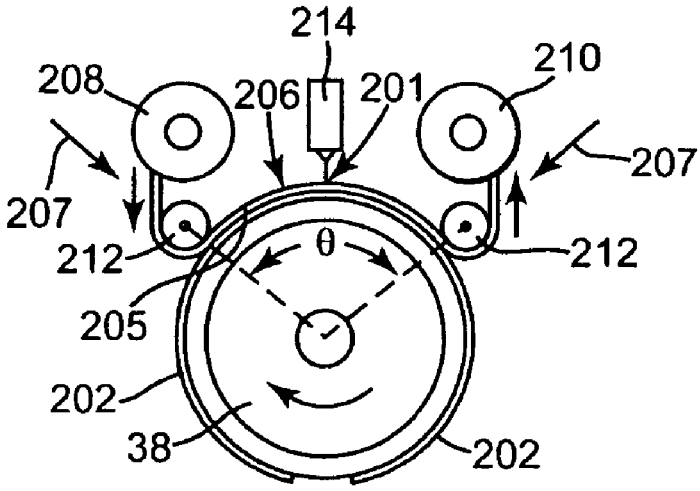
Figure 14:
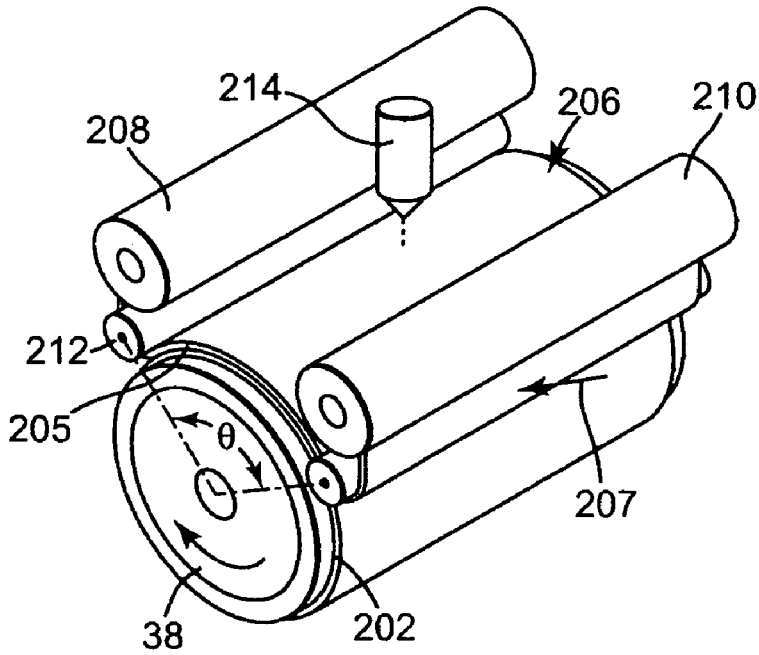
FIG. 14 illustrates a perspective view of the embodiment illustrated in FIG. 5.

FIGS. 5 and 14 depicts respective end and perspective views of the exemplary embodiment of the laser-induced thermal transfer printer apparatus of FIG. 4. As depicted in FIGS. 5 and 14, an acceptor element 202, such as a substrate or precursor for a lithographic, flexographic or gravure printing plate or cylinder, is affixed to the outer circumference of a cylindrical drum 38. A donor sheet 206 is provided by dispensing roller 208 and is received by receiving roller 210. Contact rollers 212 cause a portion of donor sheet 206 located between dispensing roller 208 and receiving roller 210 to be brought into substantially coextensive contact along the width of a portion of acceptor element 202 affixed to cylindrical drum 38, so that the donor sheet 206 is located between that portion of acceptor element 202 and the laser imaging head 214. The portion of donor sheet 206 which is brought into substantially coextensive contact with acceptor element 202 by contact rollers 212 preferably includes only arcuate section 205 the area of acceptor element 202 and donor sheet 206 generally proximate to the portions thereof being scanned by the laser imaging head 214. Arcuate section 205 includes projection area 201.

In one preferred embodiment of the invention, the donor sheet 206 may comprise a transfer layer comprising a photothermal converter. In another preferred embodiment of the invention, the donor sheet 206 may comprise a transfer layer and a layer adjacent to the transfer layer, wherein the layer adjacent to the transfer layer comprises a photothermal converter.

In another embodiment of the invention, the donor sheet 206 may include a donor material having an ink-affinity that is generally opposite to the ink-affinity of the surface of the acceptor element 202. For example, the donor material may be hydrophilic and the surface of the acceptor element 202 may be oleophillic. Conversely, the donor material may be oleophillic and the surface of the acceptor element may be hydrophilic.

The dispensing roller 208, receiving roller 210, contact rollers 212 and cylindrical drum 38 rotate in a synchronous manner, so that the portion of donor sheet 206 and acceptor element 202 which are in contact with one another between contact rollers 212 move in tandem, in a substantially intimate rolling manner and with minimal slippage with respect to one another. In this way, tangential displacement and friction is minimized between the contacting portions of the donor sheet 206 and acceptor element 202.

Laser imaging head 214 provides the scanning laser energy necessary to transfer the desired donor material from donor sheet 206 to acceptor element 202, thereby forming the desired image on receptor sheet 202. The laser imaging head 214 typically performs the scanning function by traveling in a suitable guide track (not shown) parallel to the axis of the cylindrical drum 38. This is normally performed under the direction of a control unit (not shown) connected to laser imaging head 214. The same or another control unit connected to laser imaging head 214 typically provides suitable energy thereto to effectuate the desired transfer of donor material from donor sheet 206 to acceptor element 202. Image-generating data is typically provided to laser imaging head 214 by a control unit (not shown) which is connected thereto and which typically includes image memory.

Laser imaging head 214 typically contains multiple laser beams for scanning the portion of the donor sheet 206 and acceptor element 202 being imaged. The focal spots of the lasers contained in laser imaging head 214 are typically configured to be located at or proximate to the interface between the portions of donor sheet 206 and acceptor element 202 located between contact rollers 212, and are configured to move in a reciprocating manner along the direction of the axis of cylindrical drum 38. Such movement of the laser focal spots typically is accomplished by appropriate movement of the laser-imaging head 214 relative to donor sheet 206, or alternatively by rotating one or more mirrors located in the laser imaging head 214.

Figure 6:
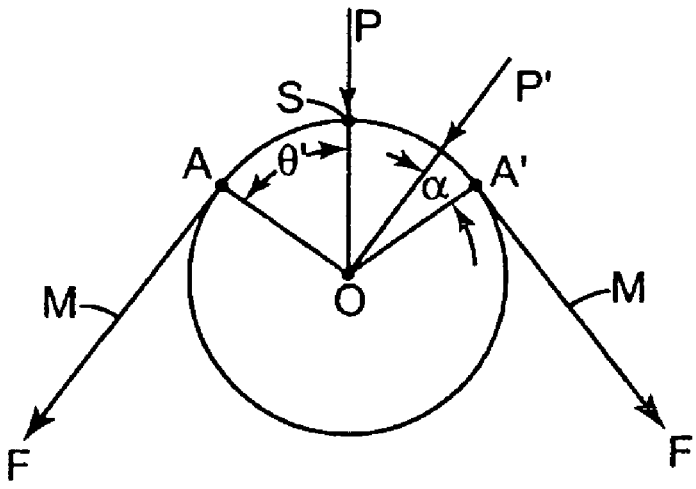
FIG. 6 illustrates schematically how the pressure applied to the drum by the sheet varies along the drum segment in the laser-induced thermal transfer printing device of the present invention.

FIG. 6 schematically represents the variation of pressure P applied to the drum by the sheet under media tension F along the drum segment where the media sheet contacts the drum. The media sheet M is wrapped on the drum segment between point A where it tangentially contacts the drum and the point A' where it leaves the drum. The maximum pressure is at the top S of the segment. At point S the pressure is given by the equation:

$$S=2KF \sin \theta'$$

where K is a constant and θ' is the angle subtended at the center of the drum by the arc AP. Going clockwise from point S, the pressure gradually decreases to reach a minimum at point A' where the media leaves the drum. The pressure applied at different points such as P' along circular segment S-A' gradually decreases as a function of the angle α subtended at the center of the drum by the are A'P'.

Figure 7:
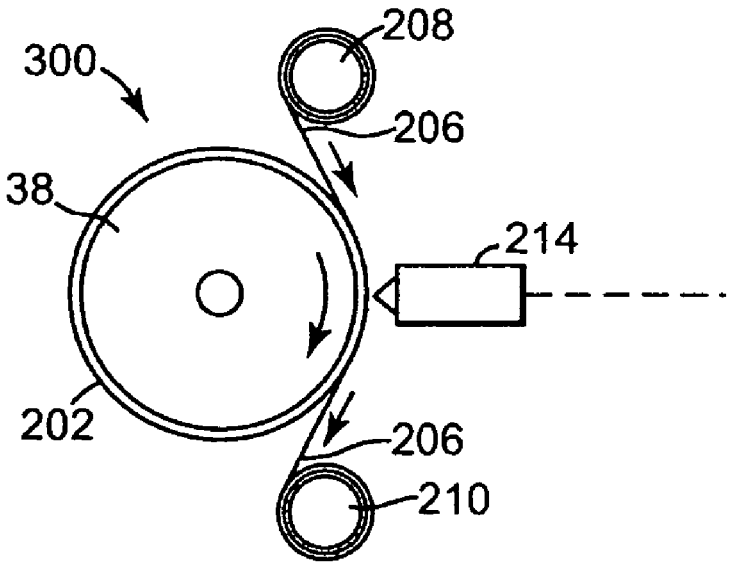
FIG. 7 illustrates another exemplary embodiment of the laser-induced thermal transfer printing device of the present invention, in which contact rollers are not utilized to bring the donor sheet into contact with the acceptor element, where the acceptor element is an acceptor sheet.
Figure 15:
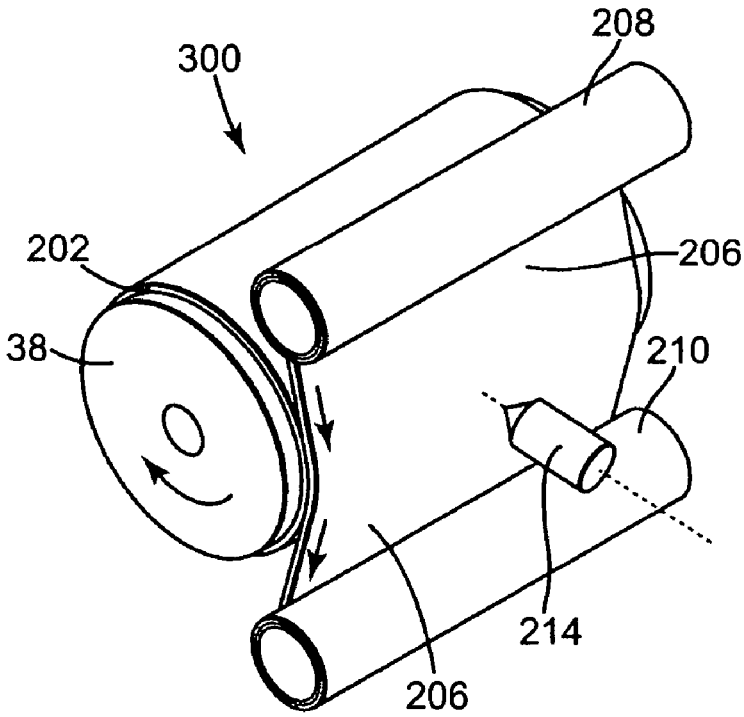
FIG. 15 illustrates a perspective view of the embodiment illustrated in FIG. 7.
Figure 16:
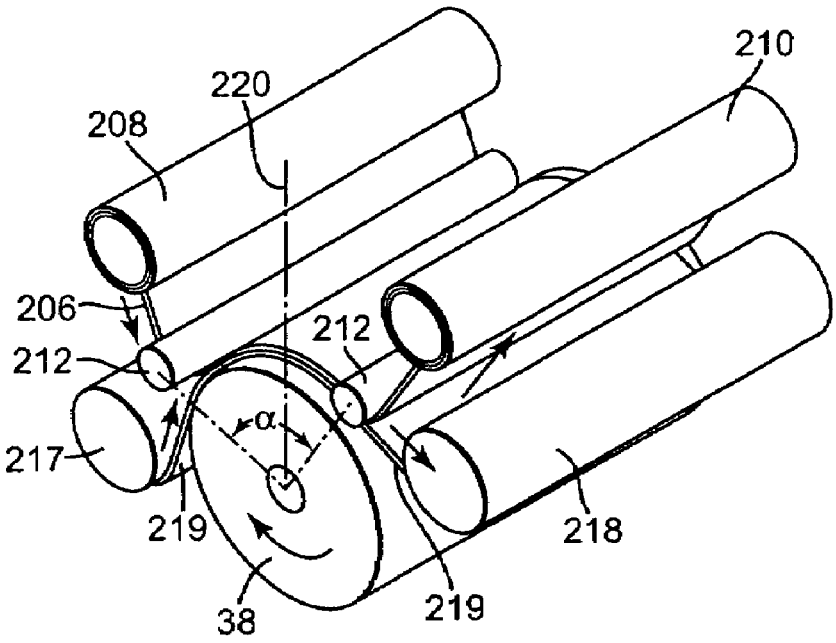
FIG. 16 illustrates a perspective view of the embodiment illustrated in FIG. 8.

FIGS. 7 and 15 depict respective end and perspective views of another exemplary embodiment of the laser-induced thermal transfer printer apparatus 300 of the present invention. The exemplary embodiment depicted in FIGS. 7 and 15 is similar to that depicted in FIG. 5, except that contact rollers 212 are not used to bring donor sheet 206 into substantially coextensive contact with acceptor element 202. Instead, donor sheet 206 is brought into contact with acceptor element 202 by dispensing roller 208 and receiving roller 210, thereby eliminating the size, cost and complexity associated with contact rollers 212.

As depicted in FIGS. 7 and 15, an acceptor element 202, such as a substrate or precursor for a lithographic, flexographic, or gravure printing plate or cylinder, for example, is affixed to the outer circumference of a cylindrical drum 38. A donor sheet 206 is provided by dispensing roller 208 and is received by receiving roller 210. Dispensing roller 208 and receiving roller 210 are configured to cause a portion of donor sheet 206 located therebetween to be brought into substantially coextensive contact with a portion of acceptor element 202 affixed to cylindrical drum 38, so that the donor sheet 206 is located between that portion of acceptor element 202 and the laser imaging head 214. The portion of donor sheet 206 which is brought into substantially coextensive contact with acceptor element 202 preferably includes only the area of acceptor element 202 and donor sheet 206 generally proximate to the portions thereof being scanned by the laser imaging head 214.

The dispensing roller 208, receiving roller 210 and cylindrical drum 38 rotate in a synchronous manner, so that the portion of donor sheet 206 and acceptor element 202 which are in contact with one another move in tandem in a substantially intimate rolling manner and with minimal slippage with respect to one another. In this way, tangential displacement and friction is minimized between the contacting portions of the donor sheet 206 and acceptor element 202. The operation and scanning functions performed by laser imaging head 214 are similar to those described above in connection with FIG. 5.

Figure 8:
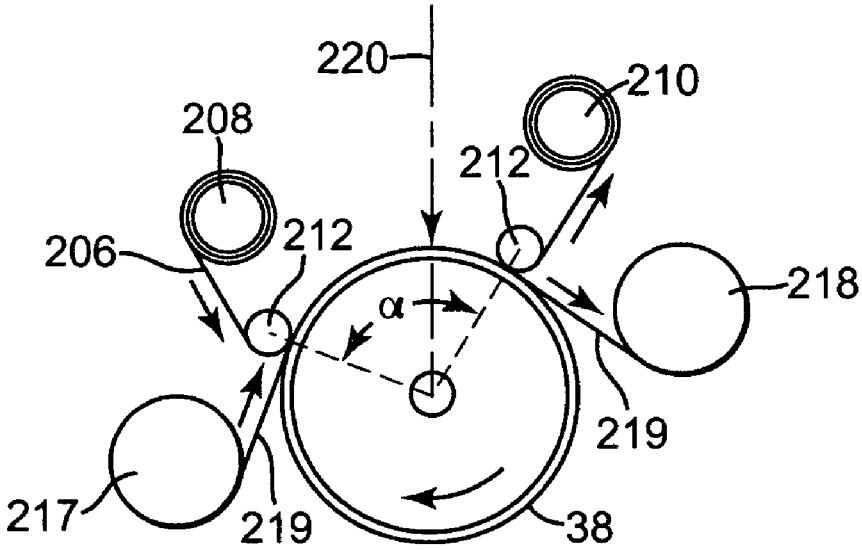
FIGS. 8-9 illustrate other exemplary embodiments of the laser-induced thermal transfer printing device of the present invention, in which a supporting drum is associated with the acceptor element in the form of a continuous web.
Figure 9:
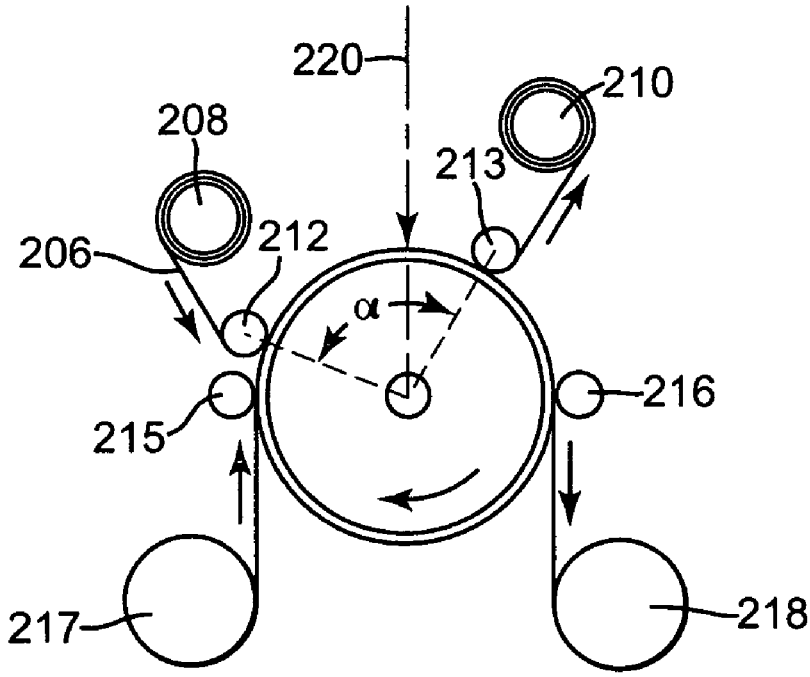
Figure 17:
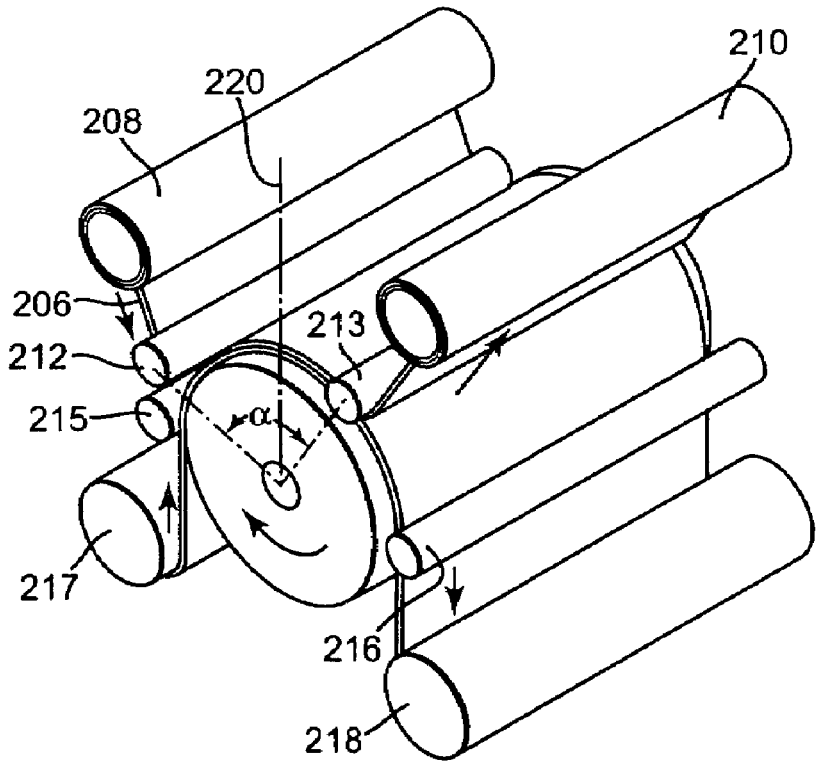
FIG. 17 illustrates a perspective view of the embodiment illustrated in FIG. 9.

FIGS. 8 and 16 and 9 and 17 illustrate other exemplary embodiments of the laser-induced thermal transfer printing device of the present invention. The apparatus of FIGS. 8 and 16 includes a donor sheet 206, a dispensing roller 208 and receiving roller 210, and contact rollers 212. The apparatus also includes a supporting drum 38 which is associated with the acceptor element in the form of a continuous web comprising a "blank" receiver spool 217, a receiver sheet 219 and an "exposed" receiver spool 218. The drum is made of light and rigid material and can rotate freely. It may be a support or it may be driven by a motor. In the apparatus of FIGS. 9 and 17, contact roller 213 is a drive roller, and a second drive roller 215 contacts the surface of the drum 38 between drive roller 213 and imaged receiver spool 217. Contact roller 212 is a pressure roller, and a second pressure roller 216 contacts the surface of the drum 38 between pressure roller 212 and receiver supply spool 218. In FIGS. 8 and 9, the extent to which contact is present between the donor and the receiver depends on the combination of the size of the arcuate contact area, the action of the rollers that maintain taut the section of the donor pressing against the drum, and the identity of the linear speed of the donor and receiver. In FIG. 8, the two radii connecting the center of the drum and the centers of the two contact rollers define an angle $\alpha$. Angle $\alpha$ is analogously defined in FIG. 9. The larger the value of the angle $\alpha$ in FIGS. 8 and 9, the more substantial is the arcuate section 205 of contact between donor and acceptor.

Figure 10:
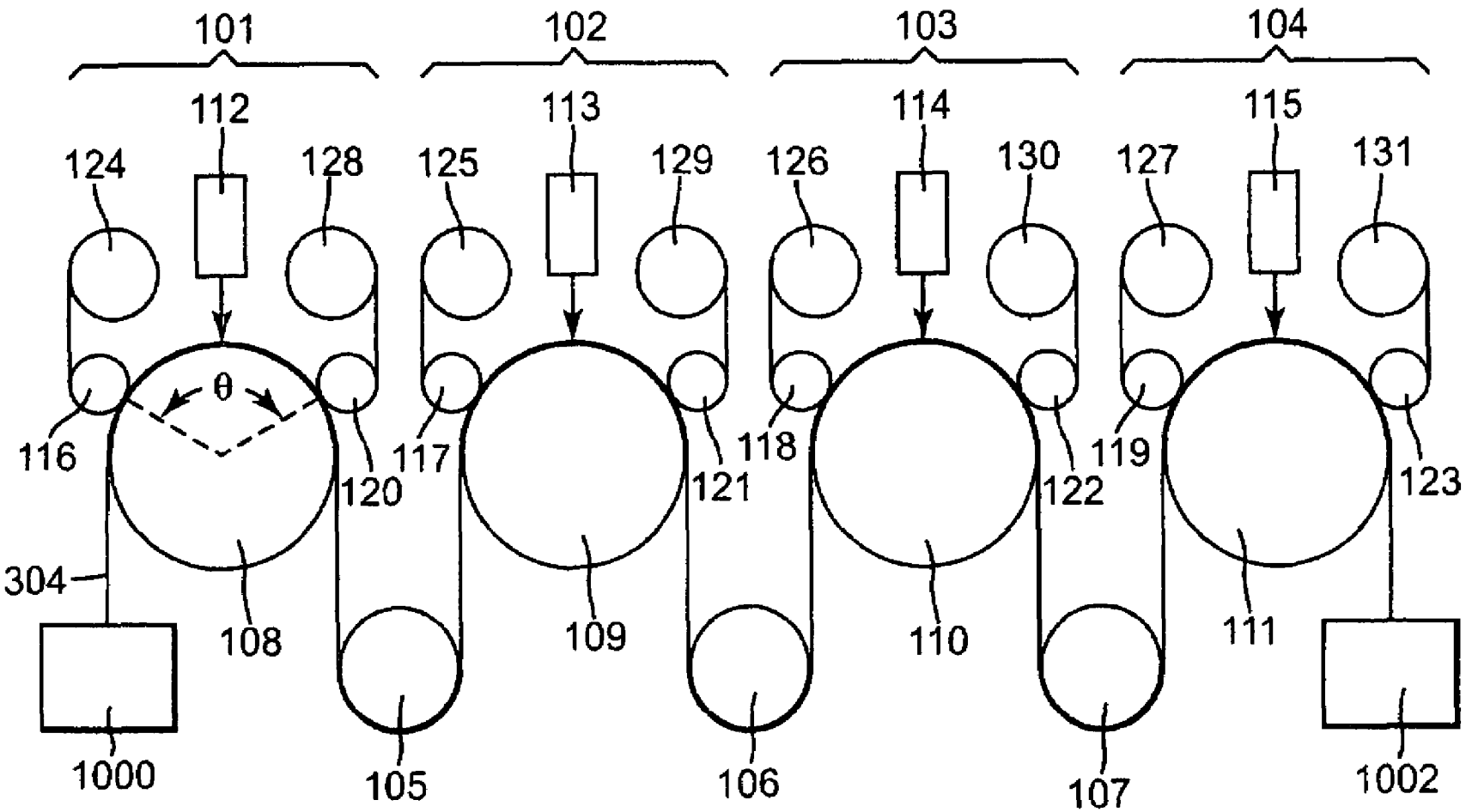
FIG. 10 illustrates another exemplary embodiment of the laser-induced thermal transfer printing device of the present invention which is suitable for color proofing.

FIG. 10 illustrates another exemplary embodiment of the laser-induced thermal transfer printing device of the present invention, in which a plurality of the printing device units of FIG. 5 are connected by means of a plurality of transfer systems. The embodiment of FIG. 10 is especially suitable for color proofing, since donor-acceptor contact is limited to an area substantially smaller than a whole sheet of material. The acceptor element is affixed to a curved section of the cylindrical drum. In FIG. 10, the curved section corresponds to about one-half of the circumference of the drum. This feature of the invention makes it possible to use material in roll form for the donor as well as for the acceptor. The embodiment described in FIG. 10 takes advantage of the fact that laser induced thermal transfer does not require considerable pressure of donor to acceptor. The production of color proofs involves the serial passage of the receptor 304 through four similar units shown at 101, 102, 103, and 104. These units differ only in that each one is dedicated to a different color, as determined by the donor material. For example, 101 can be dedicated to Cyan, 102 to Yellow, 103 to Magenta and 104 to Black. The "blank" receptor material can be supplied either in the form of sheets or roll as shown at 1000 and the exit of the "colored" receptor at 1002. Free-rotating transfer drums are shown at 105, 106 and 107. The supporting drums, that could be freely rotating or driven at a selected speed, are shown at 108, 109, 110 and 111. Similar thermal laser projection units are shown at 112, 113, 114 and 115. The angle $\theta$ represents the contact angle in which receptor and donor move in unison. Input rollers are shown at 116, 117, 118, and 119 and exit rollers at 120, 121, 122, and 123. The acceptor element or sheet is extended between a contact roller of one printing device unit and free-rotating transfer drum 105, 106, or 107, and the acceptor element or sheet is extended between the rotatably mounted transfer drum a contact roller of another printing device unit. The input supply of donor material is shown at 124 for Cyan, 125 for Yellow, 126 for Magenta and 127 for Black. The exit of used donor material is similarly show at 128, 129, 130, and 131. Accurate registration means are provided as is well known in the industry to insure the exact location and superposition of each color at each stage. Thus, FIG. 10 schematically depicts a single-pass color-proofing unit representing a substantial progress in the printing field where a substantial number of colored pages is involved.

In contrast, in the arrangements described in U.S. Pat. Nos. 5,257,038, 6,204,874, 5,764,268, and 5,734,409, to produce one single color sheet involving the superposition of four basic colors, it is necessary to go through four delicate and time-consuming manipulations in sequence (see, e.g., U.S. Pat. No. 5,257,038, column 8, lines 9 to 36). This lengthy procedure has a detrimental effect on the production rate of proofs and involves many colored pages for several printing plates.

Figure 11:
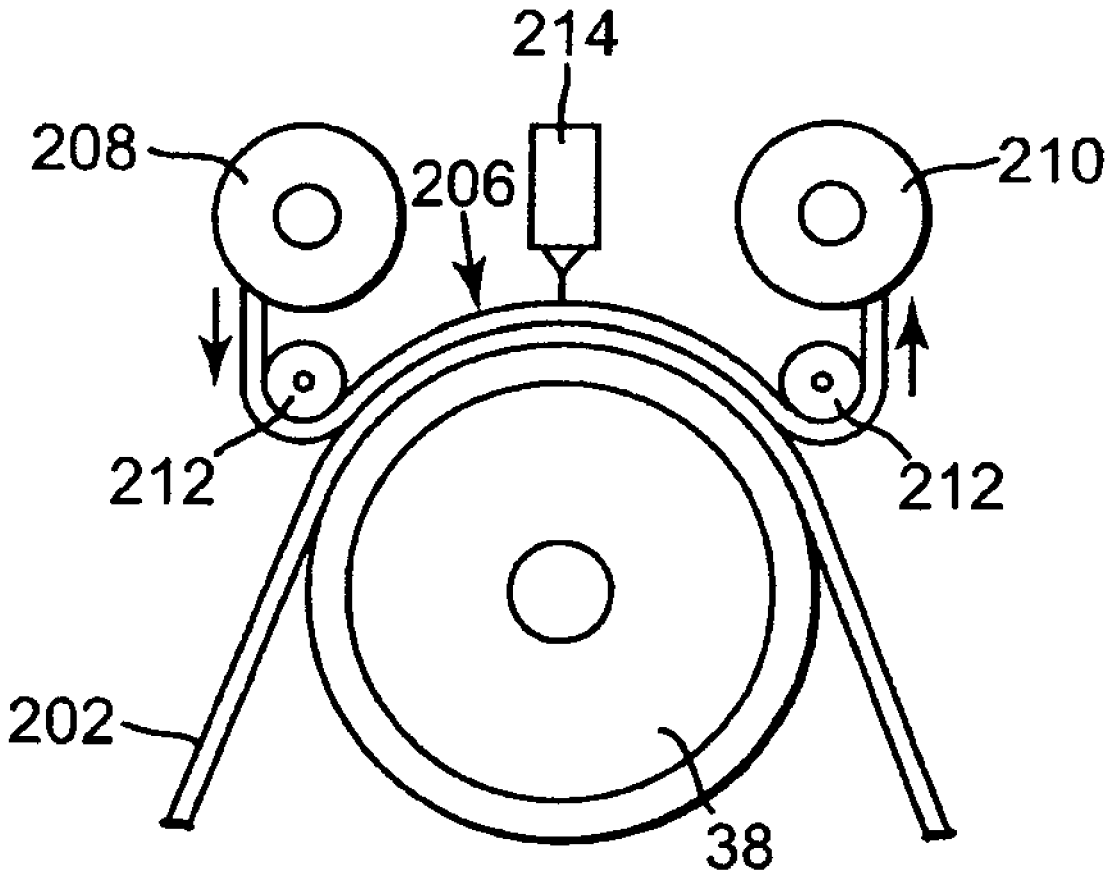
FIG. 11 illustrates another exemplary embodiment of the laser-induced thermal transfer printing device of the present invention in which the acceptor element may be cut before the receiver roll is imaged.

FIG. 11 illustrates another exemplary embodiment of the laser-induced thermal transfer printing device of the present invention. FIG. 11 is similar to FIG. 5 except that the acceptor element 202 is not affixed to the entire surface of the drum but rather may be cut before the entire receiver roll is imaged.

Figure 12:
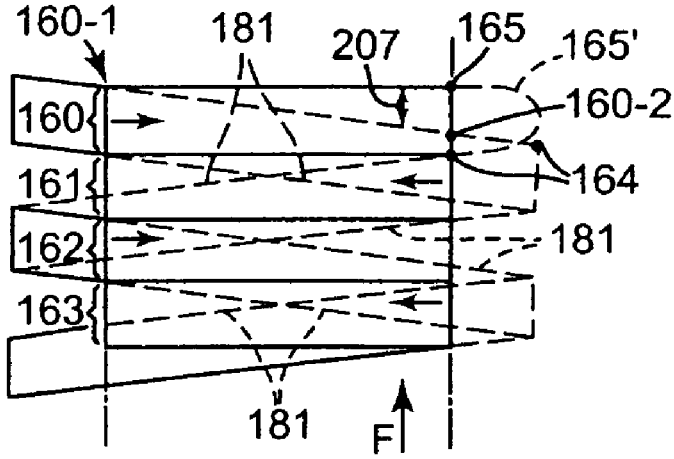
Fig. 12 (PRIOR ART)
FIGS. 12-13 show a prior art embodiment of a method to avoid image skewing in a continuous scanning mode.
Figure 13:
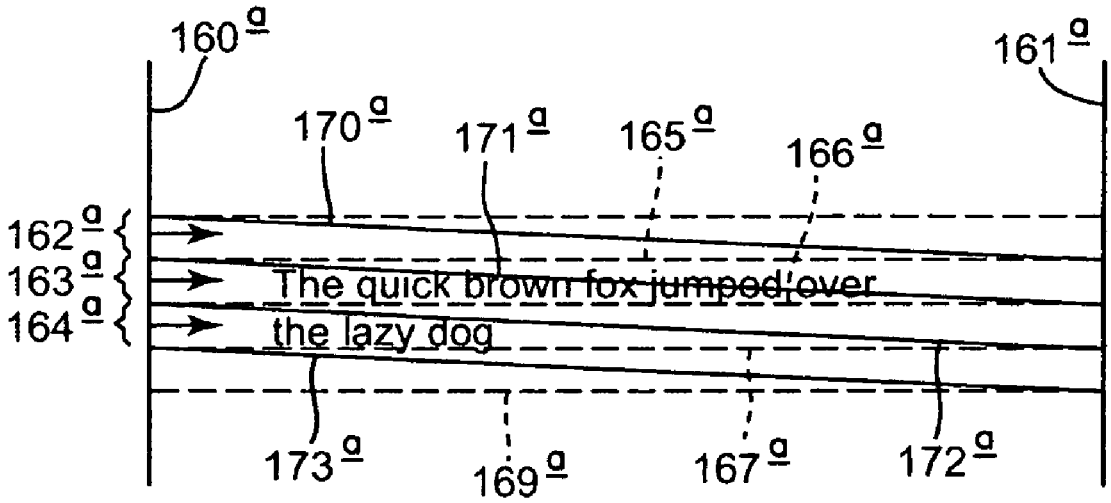
Fig. 13 (PRIOR ART)

The imaging system comprises a plurality of independent controllable laser beams. If scanning is continuous, the combination of the movement of a laser beam and the rotation of the drum causes the dots forming the image to be skewed or non-symmetrically disposed. The skewing may be prevented as described in FIGS. 7 and 8A of U.S. Pat. No. 4,819,018 (herein incorporated by reference), which correspond to FIGS. 12 and 13 herein, respectively. The solid lines of FIG. 12 represent a series of four contiguous image areas or blocks 160 to 163 as they would appear on the film if the carriage were projecting the light emerging from only the highest and the lowest gates in an array of light gates. The thin phantom lines such as 181 represent the traces that would be left on the film by the highest and lowest active light gates, in absence of any compensation. The direction of travel of the carriage is shown by an arrow in each block. The compensating means shifts the location of the active gates to keep the light from the uppermost active gate in synchronism with the film motion so that it moves in a straight line perpendicular to the edge of the film from position 160-1 (beginning of projection) to point 165 (end of projection). If no compensation were made, point 165 would be at 160-2. The curve followed by the light from the uppermost active gate if it were "on" during turn-around of the carriage is shown at 165'. The distance between point 160-2 and 165 represents the compensating value produced by the correction mechanism during the actual projection of the image block, and the distance between points 160-2 and 164 represents the distance traveled by the film during the turn-around time. FIG. 13 illustrates two lines of text for which each sweep of the laser beam always starts at the left margin, 160*a*, with spacing such that the sweep accurately joins with the preceding sweep. In the first sweep defined by the left and right margins 160*a* and 161*a*, and dashed lines 165*a* and 166*a*, the computer previously will have stored instructions such that all of the characters in the first line of the example, "The quick brown fox jumped" over will be formed, except for the descenders or lower portions of the letter "q" and "j". The instructions stored for the next sweep defined by dashed lines 166*a* and 167*a* ensure that all of the characters "the lazy dog" will be formed during that sweep, except for the descenders of the letters "y" and "g" and the descenders of the first line. For the third sweep, defined by dashed lines 167*a* and 169*a*, the only instructions stored are those for the descenders of the letters "y and g". The addresses from which instructions are retrieved are shifted by one for every 100 vertical lines in the sweep. By this means, the character portions between the solid lines 170*a* and 171*a* will be formed during the first sweep 162*a*; the character portions between lines 171*a* and 172*a* are formed during a second sweep 163*a*; and the character portions between lines 172*a* and 173*a* are formed during a third sweep 164*a*.

Figure 18:
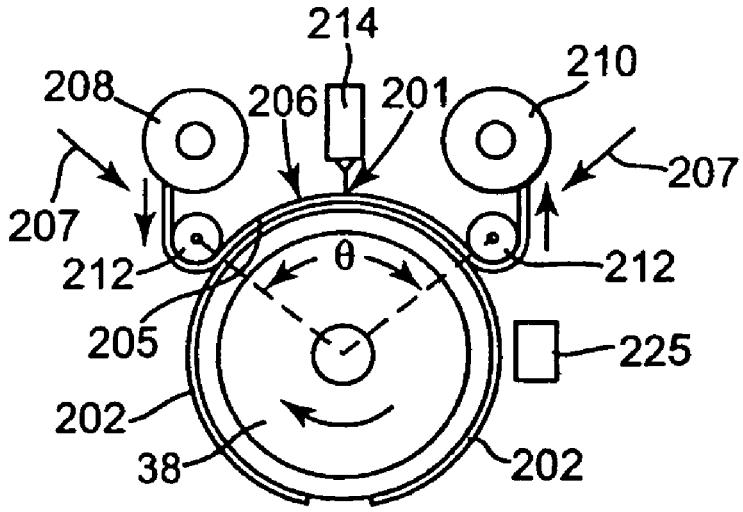
FIGS. 18-19 illustrate respective side and perspective views of another embodiment of the present invention, which includes a radiation source configured to expose the acceptor element to radiation after applying the donor material.
Figure 19:
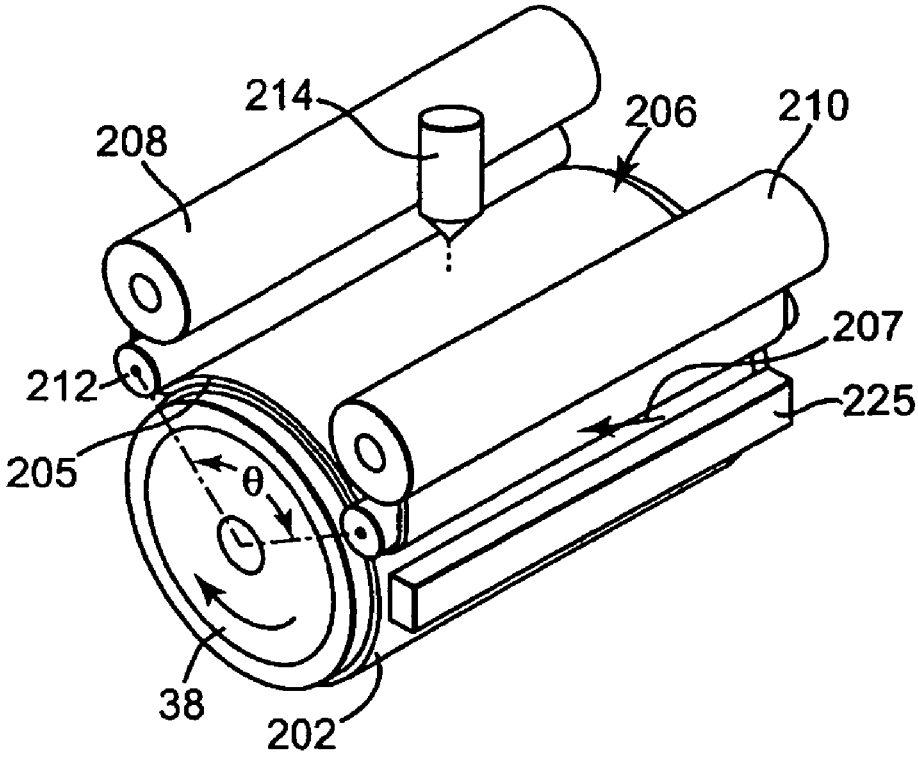

FIGS. 18 and 19 depict respective end and perspective views of another embodiment of the laser-induced thermal transfer printer apparatus, which includes a radiation source 225 positioned adjacent to laser imaging head 214 and along the length of the cylindrical drum 38. After laser imaging head 214 causes the pattern-wise transfer of donor material from the donor sheet 206 to the acceptor element 202, the radiation source 225 exposes the acceptor element 202 and the pattern-wise transferred donor material to radiation. The radiation source 225, in one embodiment, extends along the length of, and is stationary with respect to, the cylindrical drum 38. The cylindrical drum 38 rotates to expose a portion of the acceptor element 202 to the radiation source 225. Alternatively, the radiation source could travel parallel to the axis of the cylindrical drum 38 to expose the acceptor element 202 as the cylindrical drum rotates. This movement may be performed under the direction of a control unit connected to the radiation source 225.

The radiation source 225 may be configured to exposed the acceptor element 202 to, for example, ultraviolet, thermal or infrared radiation. In one embodiment, radiation exposure from the radiation source 225 may cure donor material that was transferred to the acceptor element 202 by the laser imaging head 214. In another embodiment, the radiation exposure may cause the transferred donor material and/or portions of the surface of the acceptor element 202 to become either more or less soluble in a developer.

Figure 20:
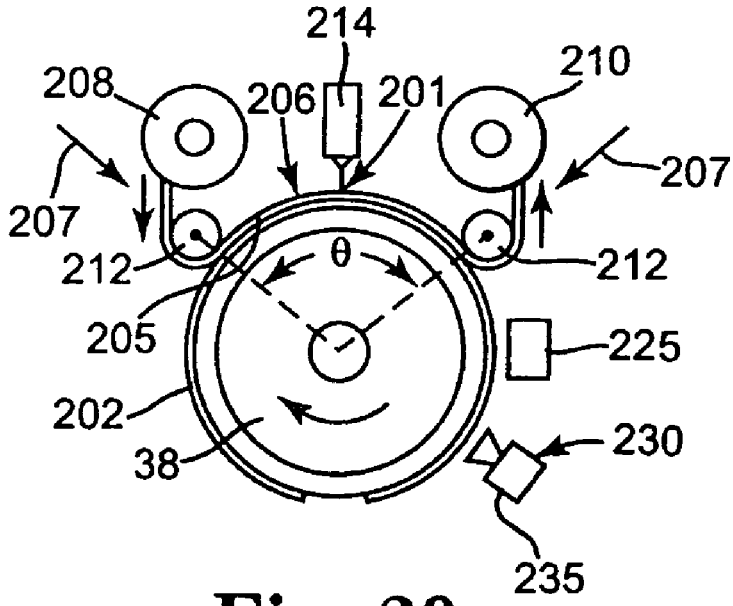
FIGS. 20-21 illustrate respective side and perspective views of another embodiment of the present invention, which includes a radiation source configured to expose the acceptor element to radiation after applying the donor material, and a developer system configured to apply developer to the acceptor element.
Figure 21:
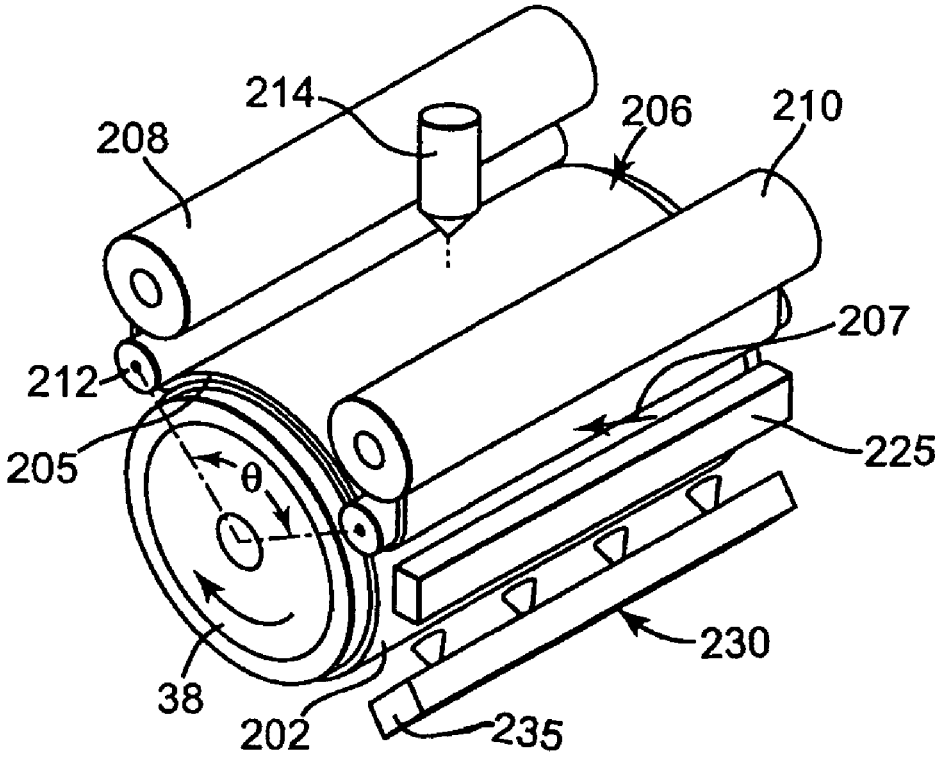

FIGS. 20 and 21 depict respective end and perspective views of another embodiment of the laser-induced thermal transfer printer apparatus of the present invention, which includes a developer system 230. The developer system 230 includes a developer application member 235 positioned along the length of the cylindrical drum 38 generally adjacent to the radiation source 225 and configured to contact portions of the acceptor element 202 with a suitable developer, optionally after being exposed to radiation from the radiation source.

In the illustrated embodiment, the developer application member 235 is configured to developer to the acceptor element 202 remotely such as by spraying the developer onto the acceptor element 202. Alternatively, the developer application member 235 could apply developer onto the acceptor element 202 by physically contacting the acceptor element, such as by brushing or similar direct application methods. Alternatively still, the developer application member 235 could include an immersion tank containing positioned to immerse portions of the acceptor element 202 in developer.

Although not illustrated, the developer system 230 generally includes a reservoir for storing developer and conduits for supplying developer to the developer application member 235. The developer system 230 may further include one or more timers, sensors, or other monitoring devices for correctly applying the desired developer onto the acceptor element 202, as well as systems for disposing or recycling used developer.

Suitable developers for use with the present invention will vary depending on the choice of donor material, acceptor element 202 and the desired final product. Suitable developers for processing lithographic printing plate precursors may fall within at least three general categories defined by the developer's pH range and whether the developer includes an organic solvent and/or dispersing agent. Each category is effective in developing particular types of radiation-sensitive compositions. A first category of developers includes highly alkaline aqueous developers, generally having a pH of greater than about 13. These developers utilize the presence of hydroxyl ions to develop the imaged printing plate precursors. Examples of developers falling within this category include ProTherrn brand developers and MX 1813 brand developers, both available from Kodak Polychrome Graphics, Norwalk, Conn.

A second category of developers includes acidic to substantially neutral developers, generally having a pH between about 2 and less than 8. Developers falling within this second category contain organic solvents, acids and/or weak bases to control pH activity, and dispersing agents (e.g. organic sulfates or sulfonates) to suspend, disperse or dissolve printing plate coating materials removed during the development process. These types of developers do not include strong bases. An example of a developer falling within this category is the Aqua-Image brand developer available from Kodak Polychrome Graphics.

A third category includes developers that have pH ranges between about 8 and less than about 13, more particularly between about 8 and about 12. These developers may contain organic solvents, dispersing agents and at least one weak base (e.g., an organic amine such as ethanolamine, diethanolamine or triethanolamine). An example of a developer falling within this category includes 956 brand developer available from Kodak Polychrome Graphics.

Suitable developers for preparing flexographic printing plates will also depend on the radiation sensitive materials used for the donor sheet and/or acceptor element. Suitable developers may include organic solvent developers, aqueous and semi-aqueous solutions. Suitable organic solvent developers include aromatic or aliphatic hydrocarbon and aliphatic or aromatic halohydrocarbon solvents, or mixtures of such solvents with suitable alcohols. Suitable semi-aqueous developers usually contain water and a water miscible organic solvent and an alkaline material. Suitable aqueous developers contain water and an alkaline material.

In gravure applications, suitable developer may encompass etchant materials suitable for forming patterned recesses in gravure master plates or materials suitable for developing radiation sensitive polymer layers or masks used in conventional gravure printing techniques.

Figure 22:
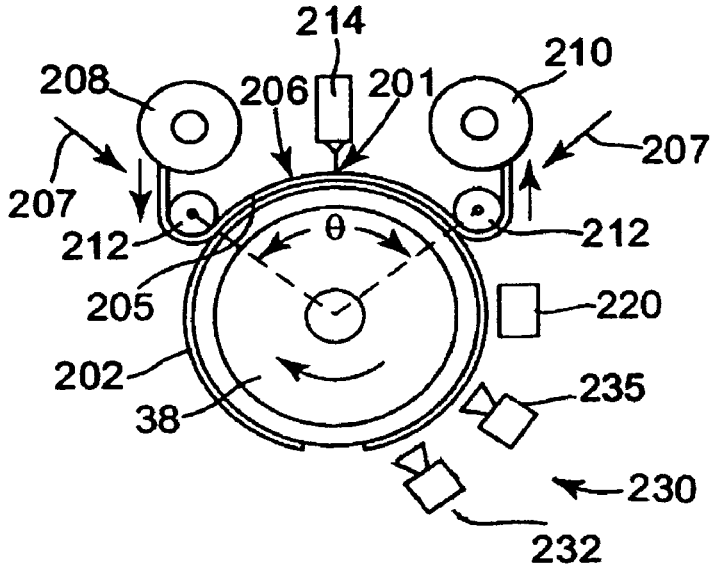
FIGS. 22-23 illustrate respective side and perspective views of another embodiment of the present invention, which includes a radiation source configured to expose the acceptor element to radiation after applying the donor material, and a developer system configured to apply a plurality of developer materials to the acceptor element.
Figure 23:
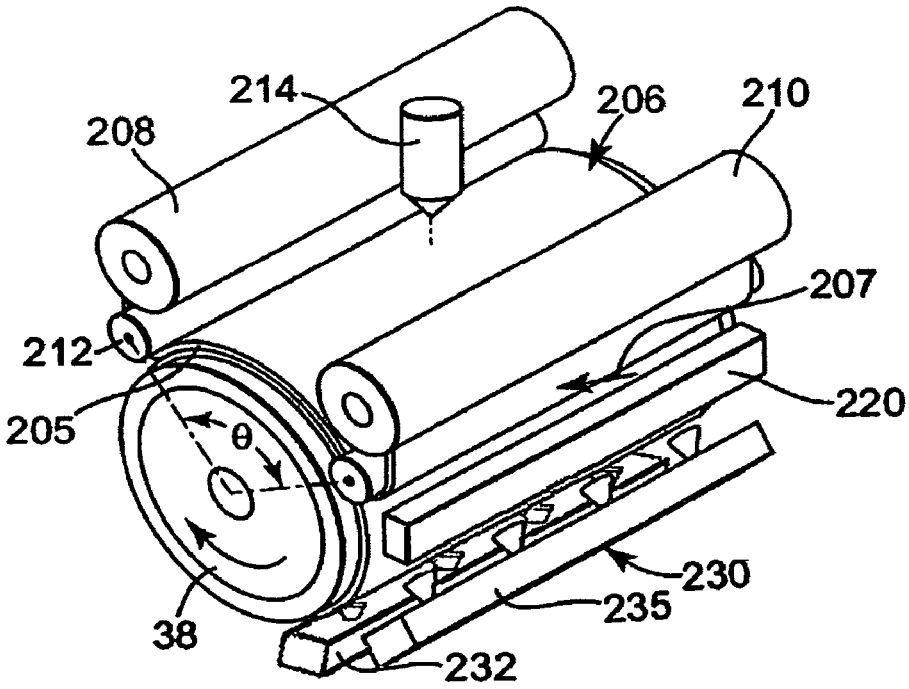

FIGS. 22 and 23 depict respective end and perspective views of another embodiment of the laser-induced thermal transfer printer apparatus of the present invention, which includes a developer system 230 having at least two developer application members 232 and 235 positioned along the length of the cylindrical drum 38 generally adjacent to the radiation source 225. This embodiment may be suitable for applications in which the choice of donor material and acceptor element 202 require a plurality of developer materials.

Figure 24:
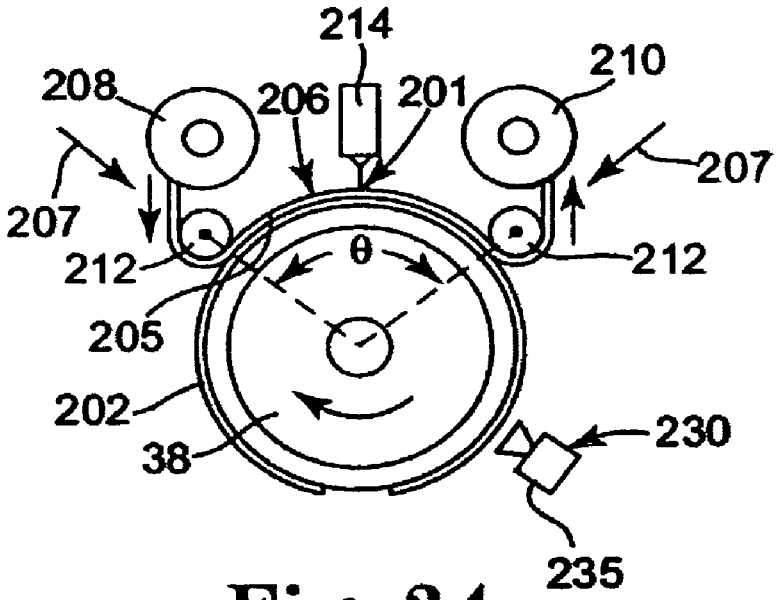
FIGS. 24-25 illustrate respective side and perspective views of another embodiment of the present invention, which includes a developer system configured to apply developer to the acceptor element.
Figure 25:
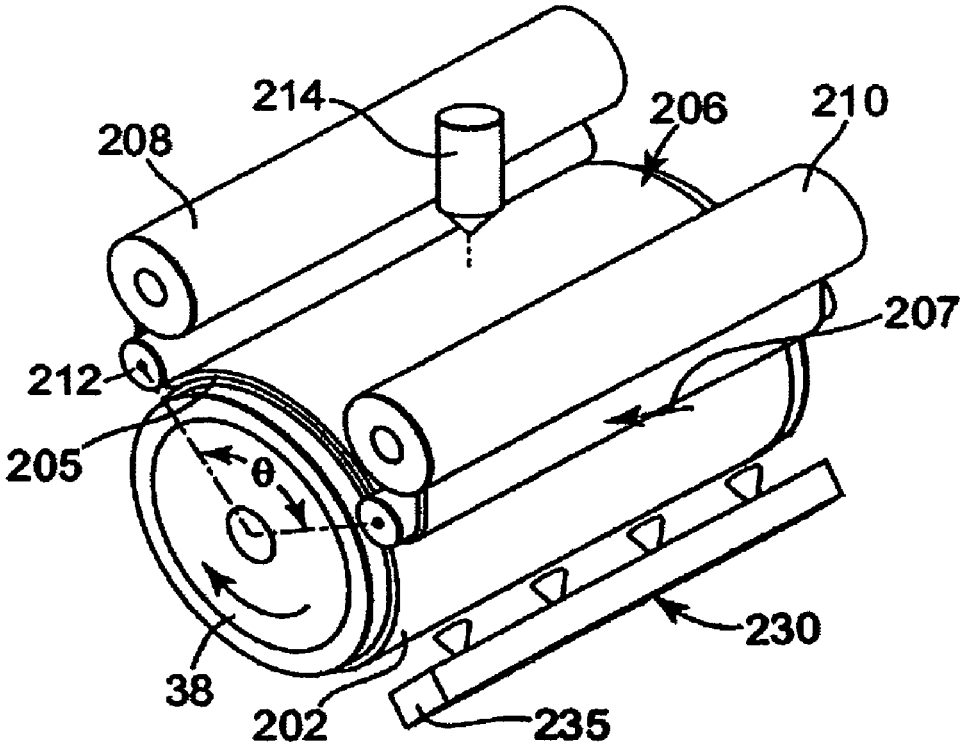

FIGS. 24 and 25 depict respective end and perspective views of another embodiment of the laser-induced thermal transfer printer apparatus of the present invention, which includes a developer system 230, but not the radiation source illustrated in FIGS. 20 and 21. This embodiment may be suitable for applications in which radiation exposure is not required prior to developing. In gravure printing applications, for example, the masking material applied to the acceptor element 202 may be resistant to developer. Additionally, in some lithographic printing applications, the acceptor element 202 has a pre-applied surface material that is developer soluble. The donor material applied to the acceptor element 202 is developer resistant. Thus, a radiation treatment is not required.

While the embodiments described above relative to FIGS. 18-25 illustrate the addition of a radiation source and/or a developer system to the embodiment shown in FIGS. 5 and 14, the radiation source 225 and/or developer system 230 may be incorporated with any of the other embodiments described above, as well. For example, the exemplary embodiment depicted in FIGS. 7 and 15, can include a radiation source and/or a developer system.

Embodiments of the present invention may be used to manufacture a variety of thermal transfer media, including lithographic, flexographic, and gravure printing plates and cylinders, as well as precursors of the foregoing. Certain embodiments, for example may be particularly suitable for use in preparing lithographic printing plates. An acceptor element 202 in the form of a lithographic printing plate substrate or precursor may be affixed to the cylindrical drum 38 and a donor material may be pattern-wise applied onto the acceptor element. The patterned donor material may then be cured by radiation source 225. In one embodiment, the surface of the acceptor element 202 is hydrophilic and the donor material is oleophilic.

Other embodiments may be particularly suitable for use in preparing flexographic printing plates. An acceptor element 202 in the form of a flexographic printing plate precursor may be affixed to a cylindrical drum 38. A mask material may then be pattern-wise applied onto a surface of the flexographic printing plate precursor. The resulting patterned precursor may then be exposed to radiation via radiation source 225 such that exposed portions of the precursor become less soluble in a suitable developer liquid while the donor material maintains its current solubility or becomes more soluble. The precursor may then be contacted by a developer liquid delivered by the developer system 230 to remove the donor material and the uncured precursor material thereunder to form a flexographic printing plate.

Other embodiments may used to prepare a gravure printing plates or cylinders, in which a mask material may be applied to the acceptor element, and exposed portions of the acceptor element may become more soluble in developer material during exposure to radiation. The donor material may maintain its current solubility or becomes less soluble after the radiation exposure. The precursor may then be contacted by a developer liquid delivered by the developer system 230 to remove the unmasked portions of the precursor material, while the masked portions of the precursor material remains on the acceptor element 202.

PROPHETIC EXAMPLE

Preparation of Donor Sheet

A dispersion (Acheson Colloids Electrodag 154) consisting of 100 parts (by weight) of graphite particles (approximately 1 micron size), 30 parts (by weight) ethyl cellulose and 650 parts (by weight) of isopropanol alcohol are combined to form a desirable coating viscosity and is uniformly coated with a slot coater onto a three mil (0.003 inch) thick transparent Mylar polyester film to a thickness which provides a light transmission density of about 3.4 (about 1.0 g/m2). The coating is dried to form the donor sheet.

Preparation of a Relief Plate

A Cyrel® 30CP (E. I. du Pont de Nemours and Company, Wilmington, Del.) flexographic printing element is placed on a drum of a thermal transfer printing apparatus such as the apparatus shown in FIG. 5. The temporary coversheet of the element is removed leaving a polyamide release layer as the outer surface barrier layer. The previously prepared donor sheet is extended between the dispensing roller and the receiving roller of the apparatus such that the infrared sensitive layer of the donor sheet is brought into contact with the polyamide release layer of the printing element by a set of contact rollers. A 256 channel thermal imaging head (available from Kodak Polychrome Graphics) is used to scan a halftone image (150 lines per inch screen) at an exposure dose of 600 mj/cm.sup.2. A black, UV-opaque mask adheres to the polyamide layer of the photosensitive plate in the areas which are exposed to the laser. In the areas which are not exposed to the IR laser, the black layer remains with the donor sheet. The element is then removed from the drum and exposed to a back flash exposure for 30 seconds through the support, and a top exposure from the mask side of 120 seconds in a Cyrel® 30×40 exposure unit. The exposed element is developed with a 3:1 mixture (vol/vol) of Perclene and butanol in a Cyrel® processor. The black mask and polyamide layer are dissolved in the developer and the unexposed areas are removed. After drying in a 60° C. oven for 15 minutes, the developed plate is simultaneously light finished and post exposed in a Cyrel® light finishing unit. Excellent image resolution is obtained.

Although the present invention has been described in connection with specific exemplary embodiments, it should be understood that various changes, substitutions, combinations and alterations can be made to the disclosed embodiments without departing from the spirit and scope of the invention as set forth in the appended claims.

The invention claimed is:

1. An apparatus for use in a printing application, comprising:

a rotatably mounted acceptor element;

a donor sheet configured to move perpendicularly relative to a longitudinal axis of the rotatably mounted acceptor element;

a plurality of rotatably mounted contact rollers configured to position a portion of the donor sheet in close proximity to a portion of the rotatably mounted acceptor element;

a laser imaging head configured to expose a portion of the donor sheet to radiation to pattern-wise transfer donor material from the donor sheet onto the acceptor element to form a patterned acceptor element, wherein the laser imaging head does not contact the donor sheet or the acceptor element; and a radiation source positioned adjacent the rotatably mounted acceptor element, which is configured to expose the patterned acceptor element to radiation, said apparatus further including a developer system positioned adjacent the rotatably mounted acceptor element for applying developer to the patterned acceptor element.

2. The apparatus of claim 1, wherein the radiation source includes an ultraviolet, thermal or infrared radiation source.

3. An apparatus for use in a printing application, comprising:

a rotatably mounted acceptor element;

a donor sheet configured to move uni-directionally relative to the rotatably mounted acceptor element;

a plurality of rotatably mounted contact rollers configured to position a portion of the donor sheet in close proximity to a portion of the rotatably mounted acceptor element;

a laser imaging head configured to pattern-wise transfer donor material from the donor sheet onto the acceptor element to form a patterned acceptor element, wherein the laser imaging head does not contact the donor sheet or the acceptor element; and a developer system for applying developer onto the surface of the acceptor element.

4. The apparatus of claim 3, wherein the developer system includes an applicator for applying the developer onto the rotabably mounted acceptor element.

5. The apparatus of claim 3, wherein the applicator includes at least one spray nozzle, brush or immersion reservoir.

6. The apparatus of claim 3, wherein the developer system is configured to apply a plurality of discrete developers.

7. The apparatus of claim 3, further comprising a radiation source positioned adjacent to the rotatably mounted acceptor element, and which is configured to expose the patterned acceptor element to radiation prior to application of developer.

8. A method for preparing a printing plate, comprising:

providing a rotatably mounted cylindrical drum including an acceptor element;

dispensing a donor sheet including a donor material from a dispensing roller, between first and second rotatably mounted contact rollers, and to a receiving roller, wherein the first and second contact rollers are configured to bring a portion of the donor sheet into substantially coextensive contact along the width of the acceptor element; and patternwise exposing the donor sheet between the first and second contact rollers to laser imaging energy to transfer donor material from the donor sheet to the acceptor element to form a patterned acceptor element, said method further comprising contacting the rotatably mounted patterned acceptor element with a developer.

9. The method of claim 8, further comprising exposing the rotatably mounted patterned acceptor element to radiation.

10. The method of claim 8, wherein the contacting includes contacting the rotatably mounted patterned acceptor element with first and second developers.

* * * * *